US010265629B2

(12) United States Patent
Bentsen

(10) Patent No.: US 10,265,629 B2
(45) Date of Patent: Apr. 23, 2019

(54) SWING FOR ADULT AND CHILD

(71) Applicant: KOMPAN A/S, Odense SØ (DK)

(72) Inventor: Nikolaj Maj Bentsen, Vejle Ø (DK)

(73) Assignee: KOMPAN A/S, Odense SØ (DK)

( * ) Notice: Subject to any disclaimer, the term of this patent is extended or adjusted under 35 U.S.C. 154(b) by 0 days.

(21) Appl. No.: 16/011,747

(22) Filed: Jun. 19, 2018

(65) Prior Publication Data

US 2018/0333647 A1 Nov. 22, 2018

Related U.S. Application Data

(63) Continuation of application No. PCT/EP2018/063025, filed on May 17, 2018.

(30) Foreign Application Priority Data

May 17, 2017 (DK) ..... 201770353

(51) Int. Cl.
*A63G 9/10* (2006.01)
*A47D 13/00* (2006.01)

(52) U.S. Cl.
CPC ..... *A63G 9/10* (2013.01)

(58) Field of Classification Search
CPC ... A63G 9/00; A63G 9/02; A63G 9/12; A63G 9/16; A47C 3/0255; A47D 13/105; A47D 13/107
USPC ..... 472/118–125
See application file for complete search history.

(56) References Cited

U.S. PATENT DOCUMENTS

| | | | |
|---|---|---|---|
| 317,028 | A | 5/1885 | Shields et al. |
| 686,420 | A | 11/1901 | Powell |
| 1,196,375 | A | 8/1916 | Medart |
| D76,611 | S | 10/1928 | Ferris |
| 2,516,975 | A | 8/1950 | Gazella |
| 2,524,967 | A | 10/1950 | Ellis |
| 2,580,920 | A | 1/1952 | Hunt |

(Continued)

FOREIGN PATENT DOCUMENTS

| | | |
|---|---|---|
| DE | 295 13 611 U1 | 10/1995 |
| DE | 29918681 U1 | 2/2000 |

(Continued)

OTHER PUBLICATIONS

Danish Search Report completed Nov. 30, 2017, in Danish Patent Application No. PA201770353 (3 pages).

(Continued)

*Primary Examiner* — Kien Nguyen
(74) *Attorney, Agent, or Firm* — Bookoff McAndrews, PLLC

(57) ABSTRACT

A swing comprising an adult seat and a child seat, said two seats connected together via a common frame and arranged such that the two seats face each other. The common frame comprises a rigid frame, said rigid frame having a first portion, a middle portion and a second portion, said middle portion being arranged between the first and second portions. The swing is arranged to be suspended from the first portion. The adult seat is attached to the second portion. The child seat is attached to the middle portion. In this way a simple construction is provided which is safe and easy to use for both adults and children.

11 Claims, 6 Drawing Sheets

(56) References Cited

U.S. PATENT DOCUMENTS

| | | | | |
|---|---|---|---|---|
| 3,825,299 | A * | 7/1974 | Gaucher | A47C 3/0255 297/157.1 |
| 4,256,300 | A | 3/1981 | Boucher | |
| 4,570,928 | A | 2/1986 | Smith | |
| 5,938,283 | A * | 8/1999 | Babcock | A47C 3/0255 297/273 |
| 6,994,631 | B1 | 2/2006 | Habing | |
| D591,004 | S | 4/2009 | Rickman | |
| 7,578,746 | B1 | 8/2009 | Johnson | |
| 9,084,940 | B2 | 7/2015 | Norquist et al. | |
| 9,468,296 | B1 | 10/2016 | Chen | |
| 9,533,231 | B2 | 1/2017 | Peres et al. | |
| 2005/0107173 | A1 | 5/2005 | Pelletier | |
| 2015/0057092 | A1 | 2/2015 | Norquist et al. | |
| 2016/0250561 | A1 | 9/2016 | Norquist et al. | |

FOREIGN PATENT DOCUMENTS

| | | |
|---|---|---|
| EP | 2067510 A1 | 6/2009 |
| EP | 3017851 A1 | 5/2016 |

OTHER PUBLICATIONS

International Search Report dated Sep. 13, 2018, in International Application No. PCT/EP2018/063025 (5 pages).
Written Opinion of the International Searching Authority in International Application No. PCT/EP2018/063025 (8 pages).

* cited by examiner

SWING FOR ADULT AND CHILD

CROSS-REFERENCE TO RELATED APPLICATIONS

This a continuation application under 35 U.S.C. § 111(a) of pending International Application No. PCT/EP2018/063025, filed May 17, 2018, which claims the priority benefit of Denmark Application No. PA201770353, filed May 17, 2017, the entireties of which are incorporated by reference herein.

The current invention relates to a swing comprising an adult seat and a child seat, the two seats are connected together via a common frame and are arranged such that the two seats face each other. In use, the two seats will therefore share a common swinging motion.

DESCRIPTION OF RELATED ART

Swings are well known in the art and are available in many different shapes and sizes. Furthermore, swings are available which have special purposes. For example swings are known which are designed especially for toddlers and which provide extra support to the toddler. Other swings are available for two children to swing on while facing each other.

Other types of swings are available which are specifically designed to allow an adult and a toddler to swing at the same time while facing each other. This could be called an adult/child swing. Two especially relevant examples of such swings are provided in U.S. Pat. No. 9,084,940, EP3017851 and U.S. Pat. No. 9,468,296. Other examples of similar swings are provided in U.S. Pat. No. 4,570,928, U.S. Pat. No. 2,524,967 and U.S. Pat. No. 2,516,975. However, one of the problems with many of the known swings is that they are complicated and have many moving parts. Moving parts on playground equipment are not desired as it is possible to catch loose clothing and/or body parts in such moving parts which can lead to injury.

Another problem with some of the known swings is that they are supported, to a large extent, by chains connected directly to the seats. This leads to a complicated structure and again there is a risk of catching loose clothing and/or body parts between the chains and the seats.

Another problem with the known solutions is that it can be difficult for the adult to get in and out of the adult seat. This makes them difficult to use.

SUMMARY OF THE INVENTION

A first aspect of the current invention is therefore to provide a swing as mentioned in the opening paragraph which has a reduced number of moving parts such that the risk of injury is reduced.

A second aspect of the current invention is to provide a swing as mentioned in the opening paragraph where the swing reduces the need for chains in the vicinity of the users.

A third aspect of the current invention is to provide a swing as mentioned in the opening paragraph which is easy to get into and out of for an adult user.

These aspects are provided by a swing as mentioned in the opening paragraph and further characterized by the features listed in the characterizing portion of claim 1.

In one embodiment, the rigid frame can comprise a bent tubular structure. In one embodiment, the bent tubular structure can comprise at least one tube which includes the first portion, the intermediate portion, the middle portion and the second portion. In one embodiment, the rigid frame is comprised of two symmetrical bent tubes welded together along a central plane of the swing, said two symmetrical bent tubes forming left and right sides of the rigid frame respectively. In one embodiment, there are no welded connections between the first portion, the intermediate portion, the middle portion and the second portion. In one embodiment, the first portion, the intermediate portion, the middle portion and the second portion are all portions of the same integral tube or portions of left and right symmetrical tubes. In one embodiment, the rigid frame has a rough Y shape where the second portion of the rigid frame is relatively narrow compared to the first portion of the rigid frame which is wider. In one embodiment, the first portion is at least twice as wide as the second portion.

In one embodiment, the intermediate portion of the rigid frame is located between the adult seat and the child seat. In one embodiment, the portion of the rigid frame which is arranged between the middle portion and the second portion of frame is arranged between the adult seat and the child seat. In one embodiment, the term "adult seat" and/or "child seat" in this paragraph could be replaced by the phrase "vertical plane passing through the centre of area of the seating portion of the adult and/or child seat respectively, said vertical plane being arranged perpendicular to the swinging direction". In one embodiment, the frame does not comprise a portion which directly connects the second portion and the first portion, without going through the middle portion and/or intermediate portion. In one embodiment, the intermediate portion could be arranged such that when an adult is sitting in the adult seat, a portion of the intermediate portion could be located below the eye level of the adult. In one embodiment, the intermediate portion has a portion which is arranged less than 1.5 m, less than 1.25 m, less than 1.1 m, less than 1 m or less than 90 cm above the seating surface of the adult seat. In this way, the intermediate portion can be formed such that the adult user can hold onto the intermediate portion during swinging.

In one embodiment, the rigid frame can be arranged such that the first portion is arranged at a first end of the frame and the second portion is arranged at a second end of the frame. In one embodiment, the first portion can be arranged at a height above the second portion. In one embodiment, the first portion can be arranged above the middle portion and the middle portion can be arranged above the second portion. It should be noted that when terms are used which are related to the positional relationship between two objects, for example upper, lower, above, below, the orientation of the swing should be used when the swing is hanging from a support structure in a still position and with an average sized adult in the adult seat and an average sized toddler in the child seat. It should be noted that there are statistical definitions of the average sized adult and average sized toddler available in relevant literature.

In one embodiment, the adult seat can be connected to the rigid frame such that a portion of the adult seat extends to the left of the second portion of the rigid frame and a portion of the adult seat extends to the right of the second portion of the rigid frame. In one embodiment, a portion of the adult seat is arranged on one side of a vertical plane passing through the second portion of the frame and a portion of the adult seat is arranged on the opposite side of said vertical plane.

In one embodiment, the swing can be arranged such that a seating surface of the adult seat is arranged lower than a seating surface of the child seat. In one embodiment the child seat can be of the kind which is suitable for holding a toddler in a secure manner and where the child seat comprises a back support portion. In one embodiment, the child seat also comprises side support portions and a front support portion.

In one embodiment, a portion of the rigid frame located between the child seat and the first portion could comprises two spaced apart bars which are suitable for holding onto by an adult sitting on the adult seat. In one embodiment, each of the two spaced apart bars has a longitudinal axis with a major vector component in the vertical direction. In one embodiment, the two spaced apart bars are placed on a plane which is arranged between the adult seat and the child seat. In a first embodiment, the two bars are placed at a distance apart which is greater than 10 cm, greater than 15 cm, greater than 20 cm or greater than 25 cm. In one embodiment, a portion of the rigid frame located between the child seat and the second portion has a maximum width of less than 20 cm, less than 15 cm or less than 10 cm.

In one embodiment, the two spaced apart bars extend upwardly to two upper free ends, said two upper free ends being provided with connecting elements to connect the swing to flexible support elements. In one embodiment, the first portion of the swing is located at least 20 cm, at least 30 cm or at least 40 cm above a seating surface of the child seat. In one embodiment, the first portion of the swing is located at least 40 cm, at least 50 cm or at least 60 cm above the seating surface of the adult seat.

In one embodiment, the adult and/or the child seat can be rigidly connected to the rigid frame. In one embodiment, the angle between the seating surface of the adult seat and the frame and/or the angle between the seating surface of the child seat and the frame are/is constant.

In one embodiment, the first portion of the swing comprises two horizontally spaced apart connecting elements, the distance between said two horizontally spaced apart connecting elements being greater than 10 cm, greater than 20 cm or greater than 30 cm.

The invention also provides for a swing assembly comprising a swing as described herein, a support structure and pivotable elongated elements, said swing being supported by said pivotable elongated elements connected between said support structure and the first portion of the swing.

It should be noted that the current specification also discloses a second invention which could be the subject of a divisional application in the future.

The second invention relates to a swing as mentioned in the opening paragraph further characterized in that the common frame comprises a rigid frame, said rigid frame having an upper portion, a first lower portion and a second lower portion, in that the swing is arranged to be suspended from the upper portion, in that the adult seat is rigidly attached to the rigid frame at the first lower portion, and in that the child seat is attached to the rigid frame at the second lower portion. This is in contrast to the prior art swings where the adult seat is attached to a common frame via chains or where there is no common rigid frame.

In one embodiment, the adult seat is attached to the rigid frame such that a portion of the adult seat extends to one side of a vertical plane passing through the first lower portion and a portion of the adult seat extends to the other side of said plane. In one embodiment, the width of the first lower portion can be less than 20 cm, less than 15 cm or less than 10 cm. In this way, the adult user can straddle the first lower portion with his/her legs when sitting on the adult seat. In one embodiment, the first lower portion forms an angle to a seating surface of the adult seat which is greater than 90 degrees, greater than 120 degrees or greater than 145 degrees. In one embodiment, the first lower portion extends from the adult seat in a direction having a vector component which extends in the same direction as an average adult user would face when sitting on the adult seat. In one embodiment, the first and second lower portions could be arranged on either side of a vertical plane passing through the upper portion. In one embodiment, the first lower portion could be arranged lower than the second lower portion. In one embodiment, a seating surface of the adult seat could be located below a seating surface of the child seat.

In one embodiment, the upper portion of the swing comprises two connecting elements spaced apart from each other along a horizontal axis which is perpendicular to the swinging direction, the distance between said two connecting elements being greater than 10 cm, greater than 20 cm or greater than 30 cm. In one embodiment, the connecting elements are suitable for connecting the swing to flexible elongated elements, for example ropes or chains, to suspend the swing from a supporting structure.

The different embodiments described above could be combined as desired and also combined with other features disclosed in the remaining specification and claims.

The current specification also discloses a third invention which could be the subject of a divisional application in the future.

The third invention relates to a seat for a swing, said seat comprising a seating portion, a back support portion and first and second side supporting portions. The seat is arranged such that the seating portion and the back support portion are arranged pivotably with respect to each other and such that the first and second side supporting portions are arranged pivotably with respect to the back support portion, such that the seat has two configurations, a first configuration where the seating portion, the back support portion and the first and second side supporting portions are arranged essentially co-planar and a second configuration where the seating portion and the back support portion are arranged at an angle with respect to each other which is less than 135 degrees and where the first and second side supporting portions each form an angle with respect to the back support portion which is less than 135 degrees. It should be noted that in the first configuration, the respective angles are around 180 degrees. In one definition, the angles could be taken between the average centre planes of the different portions.

In this way, a seat is provided which can be manufactured in an essentially flat or 2D configuration and then bent into a seat having a 3D form which can support a child or toddler in an effective manner. By manufacturing the seat in a flat configuration, the manufacturing process becomes easier. In one example, when manufacturing the seat in a flat configuration, it is easy to insert "in-mould" components in the mould and "over-mould" or "insert mould" them together with the remainder of the seat when the moulding material is added to the mould. In one embodiment, a steel wire structure can be "insert moulded" inside the main material of the seat, said steel wire structure extending though-out the seat to provide strength and/or vandalism resistance to the seat. In another embodiment, mounting fittings can be "insert moulded" directly in the material of the seat.

In one embodiment, the seat is moulded from a pliable material which is able to provide a surface which is comfortable to sit on for a user. In one embodiment, the material is a foamed plastic material. In one embodiment, the material is a polyurethane based material or other material having similar relevant properties. In one embodiment, the material is a foamed plastic material with a soft foamed core and a more solid wear resistant surface covering. In one embodiment, the material is a rubber like material.

In one embodiment, a recess is formed in the seat which extends from a surface of the seat and in towards its core. Such a recess can be arranged to be engageable with a corresponding protrusion on a cooperating component of a swing. In one embodiment, a recess can be formed in the seat by insert moulding a hollow component in the seat. In one embodiment, the hollow component could be a tube. In one embodiment, a rigid element could be partly insert moulded in the material of the seat, where a first part is mechanically engaged with the material of the seat and a second part extends free of the material of the seat. The features of the seat for a swing as described in this specification can be combined with the features of the swing as described in this specification to provide a swing as described herein with a seat as described herein.

It should be emphasized that the term "comprises/comprising/comprised of" when used in this specification is taken to specify the presence of stated features, integers, steps or components but does not preclude the presence or addition of one or more other features, integers, steps, components or groups thereof.

BRIEF DESCRIPTION OF THE DRAWINGS

In the following, the invention will be described in greater detail with reference to embodiments shown by the enclosed figures. It should be emphasized that the embodiments shown are used for example purposes only and should not be used to limit the scope of the invention.

DETAILED DESCRIPTION OF THE EMBODIMENTS

Figure 1:
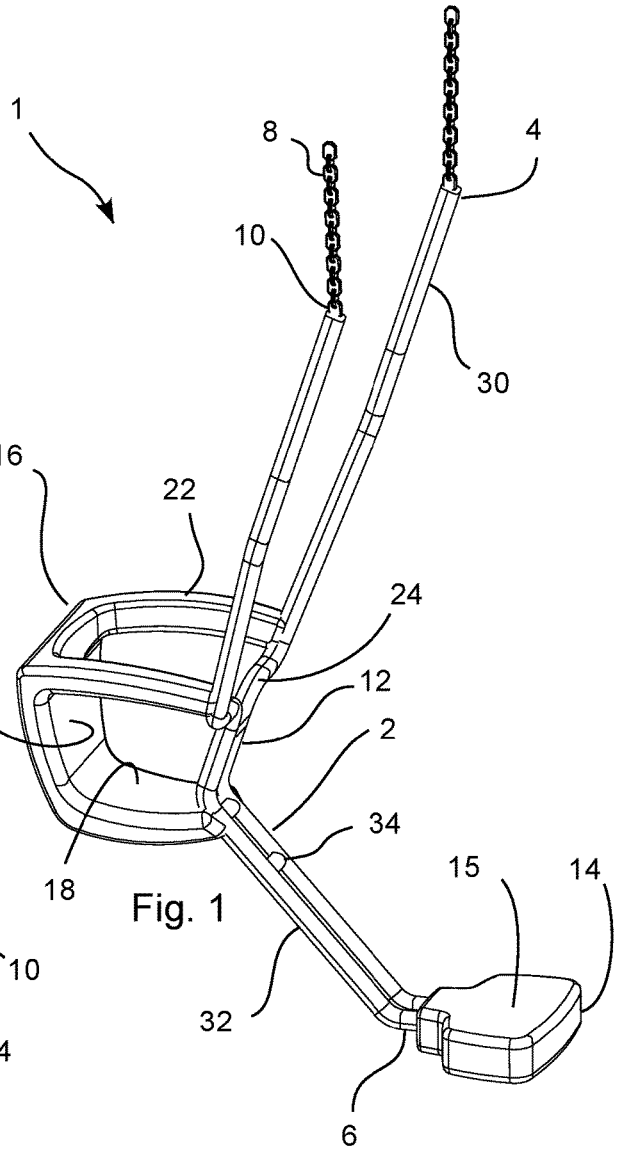
FIG. 1 shows a perspective view of a first embodiment of a swing according to the current invention.
Figure 2:
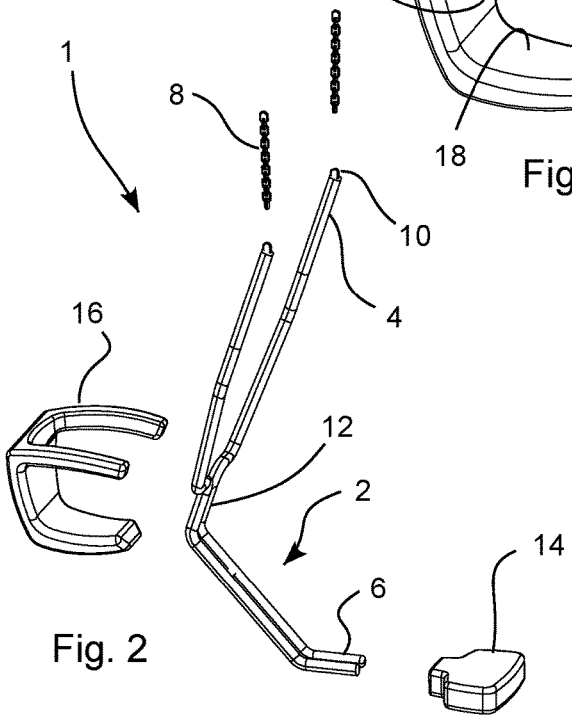
FIG. 2 shows a perspective exploded view of the swing of FIG. 1.

The swing 1 shown in FIGS. 1 to 8 is a first embodiment of a swing according to the current invention. The swing 1 comprises a rigid frame 2 which is comprised of a set of bent steel tubes. The rigid frame 2 has an upper end 4 and a lower end 6. The upper end 4 can be considered a first portion as defined in the claims and the lower end 6 can be considered a second portion as defined in the claims. The swing is suspended by chains 8 connected to connecting elements 10 located at the upper end 4 of the rigid frame. The upper ends of the chains are supported by a support structure (not shown) as is known in the art for swing assemblies. Between the upper end 4 and the lower end 6, the rigid frame comprises a middle portion 12. The portion of the tubes which is located between the middle portion 12 and the upper end 4 can be considered as the intermediate portion according to the claims.

A first seat 14 is connected to the lower end 6 of the rigid frame 2. The first seat is suitable for supporting an adult, for example a parent or a caretaker, and can therefore be called an adult seat. The first seat comprises a first seating surface 15. A second seat 16 is connected to the middle portion of the rigid frame. The second seat in the current embodiment is suitable for supporting a toddler who does not have the body strength or skill to keep him or herself safely on a normal swing. In the current embodiment, the second seat 16 has a seating surface 18, a back supporting portion 20, two side supporting portions 22 and a front supporting portion 24. It should be noted that both the first and the second seats can be used by people of different sizes and weights, however, in general, the first seat should be designed to be used by an average adult human being and the second seat should be designed to be used by an average toddler. In one example, a toddler can be defined to be a child between the ages of 1 and 4.

In the current embodiment, the rigid frame 2 is formed from two steel tubes 30, 32 which are bent into a specific shape and then welded together by cross pieces 34. From the figures it can be seen that the two steel tubes 30, 32 are mirror images of each other. However, it should be clear that the rigid frame could be provided in different manners. For example, instead of providing cross pieces, the two steel tubes could be directly welded together along the lower portion of the frame. In another embodiment, instead of providing two tubes which are joined together, the frame could comprise a single bent tube which is bent 180 degrees at the lower end 6.

In the current embodiment, the first seat 14 is rigidly connected to the rigid frame and the second seat 16 is also rigidly connected to the frame. In other words, the seating portions 15, 18 of the first and second seats respectively are essentially fixed with regards to the rigid frame. This is in contrast to many of the prior art structures were the seating portions of the swing are pivotably or displaceably connected to the support frame or the support assembly. For example in some prior art cases, the support assembly comprises flexible chains which are directly connected to the first and/or second seats.

In the current embodiment, the rigid frame extends upwardly past the second seat such that the connection between the swing and the chains or other supporting elements which are used to support the swing in a swingable manner are spaced away from the second seat. In this way, there is a very small chance that loose clothing or body parts can get caught in any flexible component.

In the current embodiment, it can also be seen that the lower portion of the frame has a narrow construction and that the upper portion of the frame has a broader or wider construction. In the bottom portion, it is possible for the adult to place his or her legs on either side of the frame and thereby straddle the frame. At the upper portion, the two tubes are placed at a distance to each other allowing a user to hold onto the tubes, one tube with each hand. The adult can then see the child in the child seat through the space between the bars. It is also possible for the toddler and the adult to hold onto the same bar if the toddler's arms are long enough and thereby provides an even greater connection between adult and child. Furthermore, a very comfortable holding area is provided for the adult and the child, in contrast to many known assemblies which provide chains for holding onto.

Figure 3:
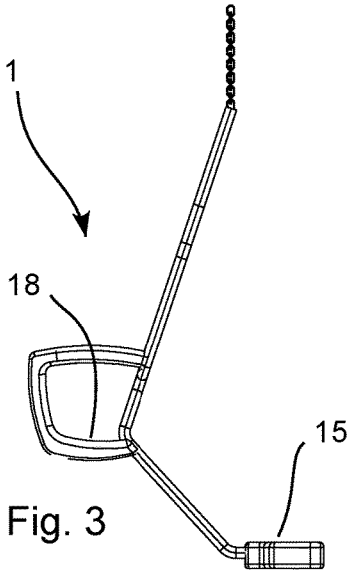
FIG. 3 shows a left side view of the swing of FIG. 1.
Figure 4:
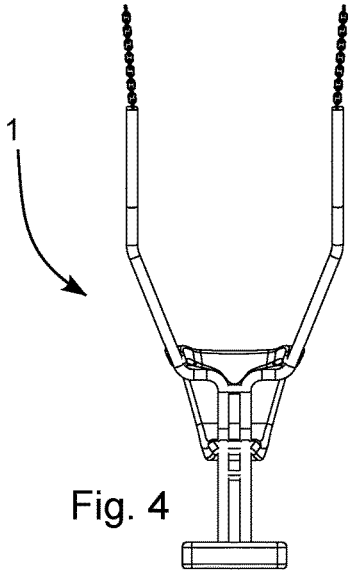
FIG. 4 shows a front view of the swing of FIG. 1.
Figure 5:
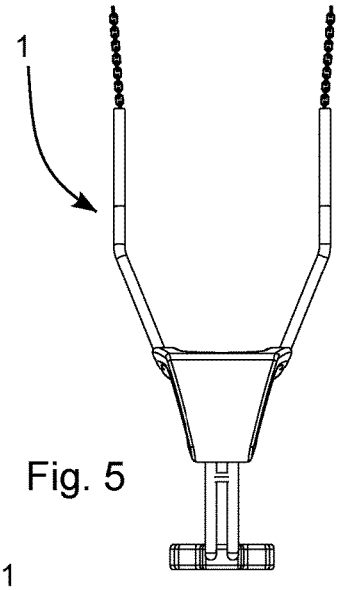
FIG. 5 shows a rear view of the swing of FIG. 1.
Figure 6:
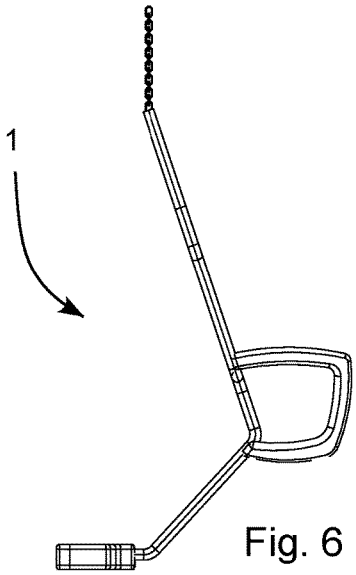
FIG. 6 shows a right side view of the swing of FIG. 1.
Figure 7:
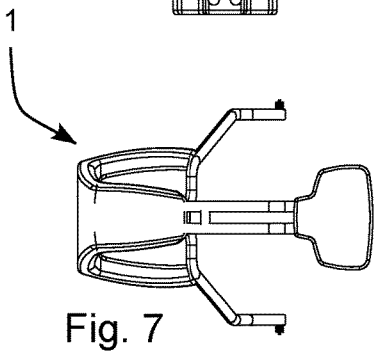
FIG. 7 shows a bottom view of the swing of FIG. 1.
Figure 8:
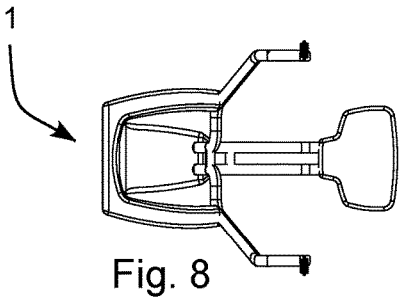
FIG. 8 shows a top view of the swing of FIG. 1.
Figure 9:
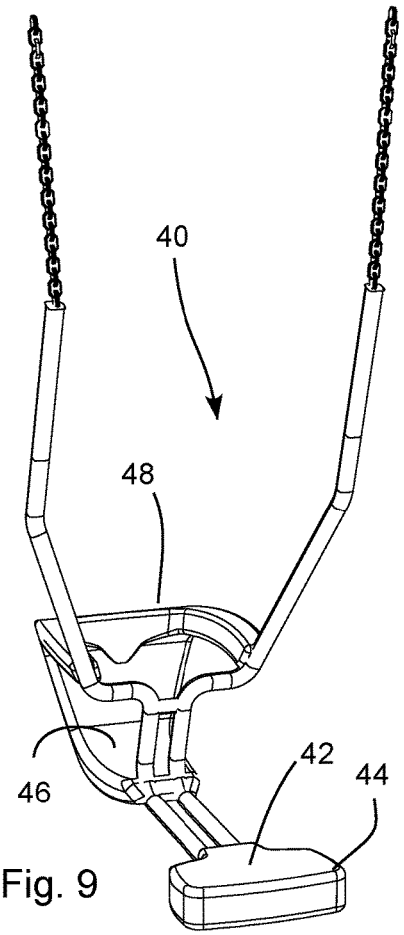
FIG. 9 shows a perspective view of a second embodiment of a swing according to the current invention.
Figure 10:
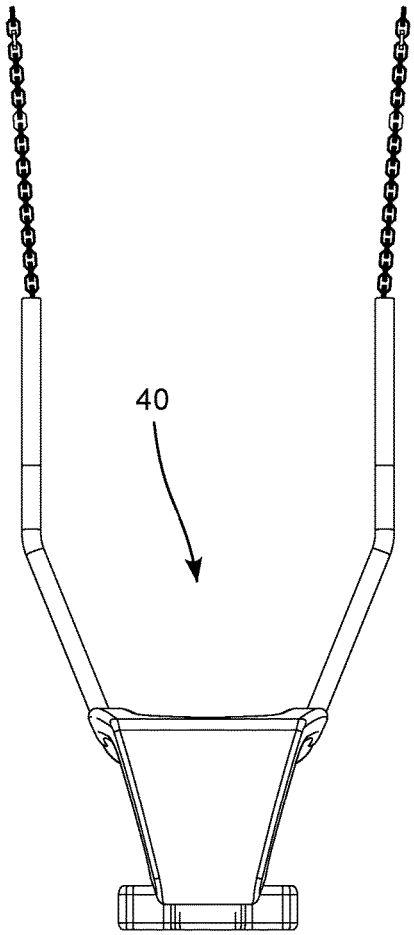
FIG. 10 shows a rear view of the swing of FIG. 9
Figure 11:
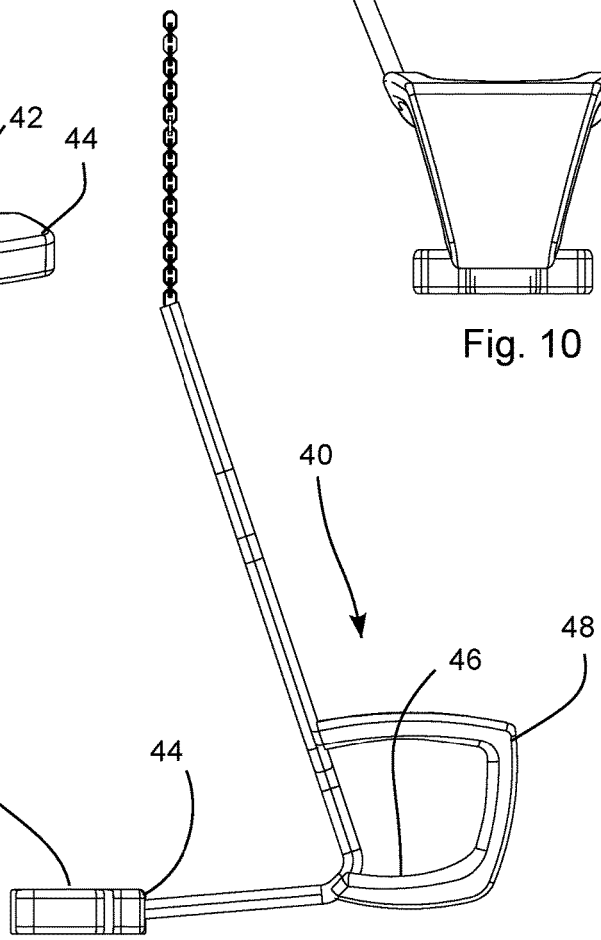
FIG. 11 shows a right side view of the swing of FIG. 9.
Figure 12:
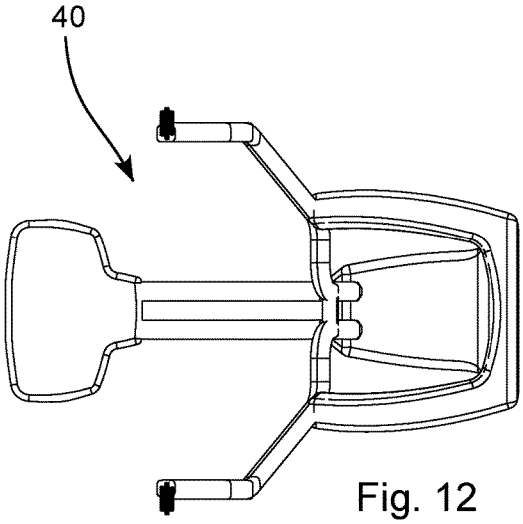
FIG. 12 shows a top view of the swing of FIG. 9.
Figure 13:
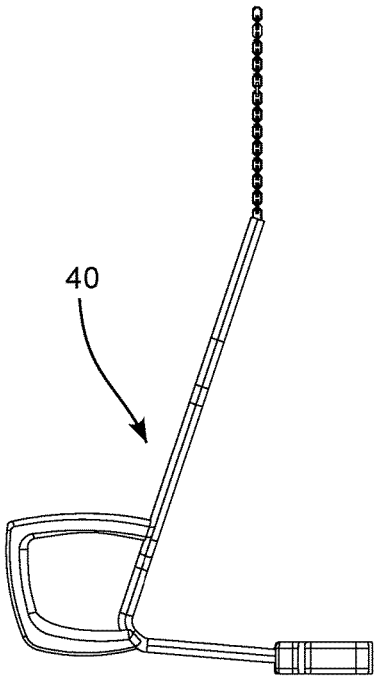
FIG. 13 shows a right side view of the swing of FIG. 9.
Figure 14:
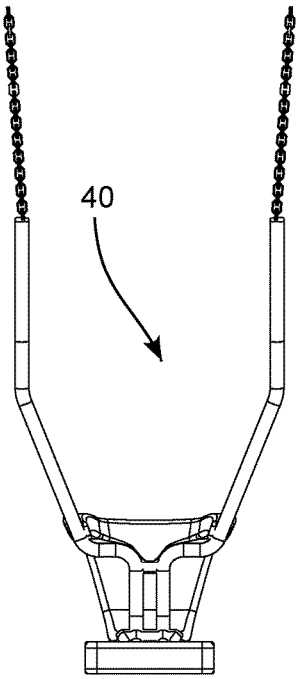
FIG. 14 shows a front view of the swing of FIG. 9.
Figure 15:
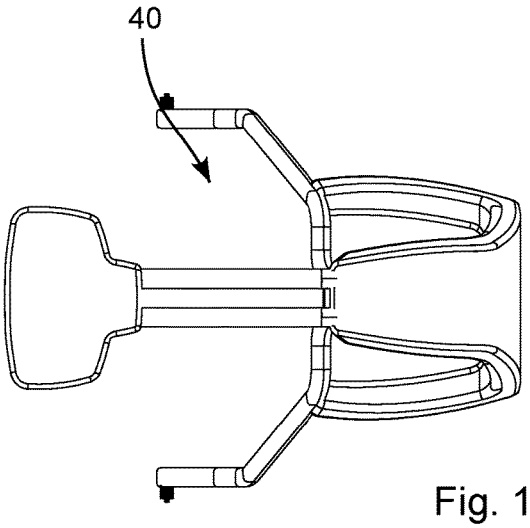
FIG. 15 shows a bottom view of the swing of FIG. 9.

It can be seen, especially from FIG. 3, that the first seating surface 15 of the adult seat 14 and the seating surface 18 of the child seat 16 of this embodiment are placed at different heights. In this embodiment, the first seating surface is provided lower than the second seating surface. In this way, when the swing is in a still position the adult will be seated lower than the child, thereby allowing a much more direct eye contact between the adult and the child.

In the second embodiment 40 of a swing shown in FIGS. 9 to 15, the general principle is the same as in the first embodiment of a swing 1 shown in FIGS. 1 to 8. As such, the swing 40 will not be described in great detail. However, it is to be noted that instead of providing the seating surface 15 of the adult seat 14 and the seating surface 18 of the child seat 16 at different heights as in the first embodiment 1, when the second embodiment of a swing 2 is in a still position, the seating surfaces 42 of the adult seat 44 and the seating surface 46 of the child seat 48 are provided at the same height.

It should be noted that the support structure to which the swing 1 of FIGS. 1 to 8 and the swing 40 of FIGS. 9 to 15 can be connected to has not been described in great detail herein. However, it is maintained that the person skilled in the art is familiar with suitable support structures. In a typical example, an upper horizontal support bar is supported at each end by an A-frame arrangement. The swing is typically connected to the upper horizontal support bar via chains or ropes.

Figure 16:
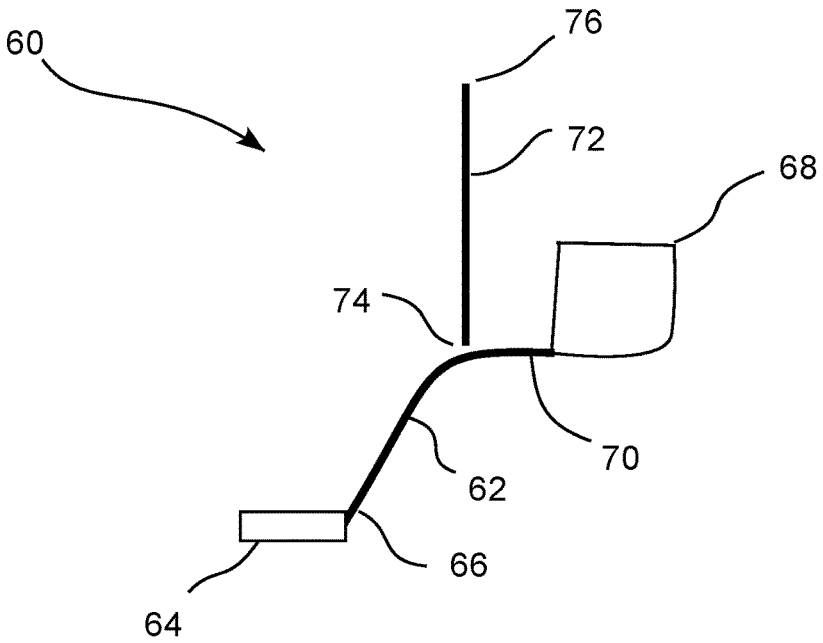
FIG. 16 shows a side view of a third embodiment of a swing according to the current invention.

FIG. 16 shows another embodiment 60 of a swing according to the current invention. In this embodiment, a lower steel tubular section 62 is provided which has a first seat 64 for an adult attached at a first end 66 and a second seat 68 for a toddler attached at a second end 70. A support bar 72 is connected to the lower steel tubular section 62 via a welded joint 74. Connecting fittings (not shown) are provided at an upper end 76 of the support bar. In this case, in the understanding of the claims, even though there are two separate tubes which are welded together, the two tubes still form a rigid frame having an upper end 76, a lower end 66 and a middle portion 70 (or first portion, second portion and middle portion). Likewise, one could also say that the upper end 76 forms an upper portion, the lower end 66 forms a first lower portion and the middle portion 70 forms a second lower portion. This terminology could also be applied to the first embodiment 1 shown in FIGS. 1 to 8 and the second embodiment 40 shown in FIGS. 9 to 15. Likewise, the support bar 72 could be considered to be the intermediate portion according to the claims.

Figure 17:
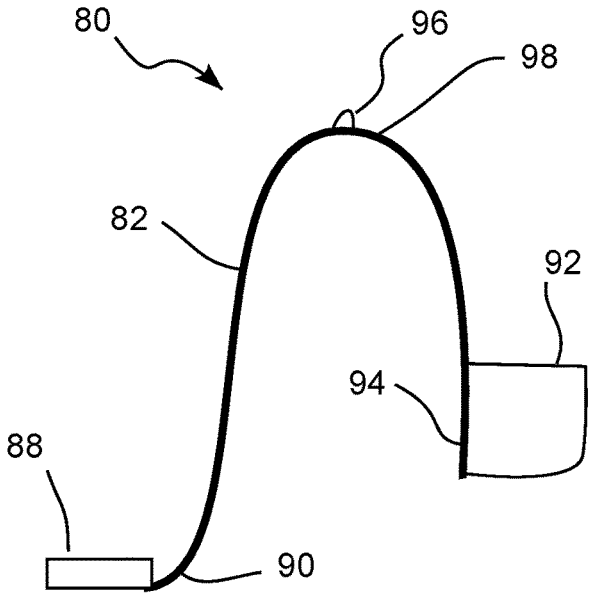
FIGS. 17 and 18 schematically show side and front views respectively of an example of a swing according to a second invention as described in the current specification.
Figure 18:
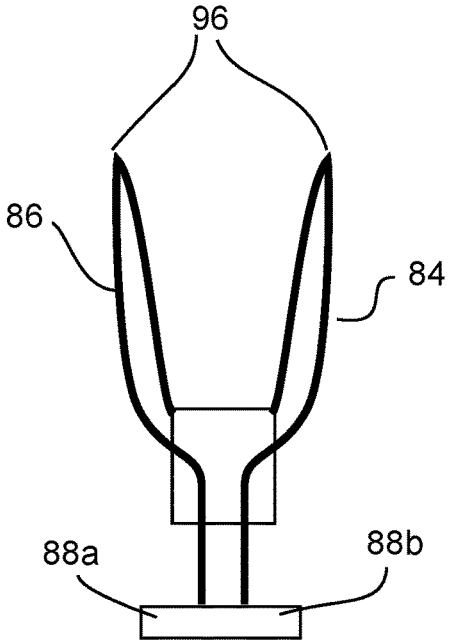

FIGS. 17 and 18 show two views of an example swing which is not covered by the current claim set, but which discloses an alternative embodiment having other inventive features which are shared by the first and second embodiments shown in FIGS. 1-15. In this example 80, a rigid frame 82 is provided, again in the form of a bent metal tubular structure. As with the first and second embodiments, in this case the frame is again provided by two symmetrical steel tubes 84, 86. A first seat 88 for an adult is provided at a first end 90 of the rigid frame and a second seat 92 for a toddler is provided a second end 94 of the frame. The swing is supported by connector elements 96 attached to the frame at a middle portion 98 located between the first and second ends 90, 94. While the form of the frame in this example is different from the form of the frame in the first and second embodiments, the frame in both cases is rigid and the connection between the seats and the frame are rigid as well. Likewise, the arrangement of the first seat is the same in this example and in the first and second embodiments. It can also be said that the swing comprises an upper portion 98, a first lower portion 90 and a second lower portion 94.

Of special interest in this embodiment, is the connection between the adult seat 88 and the rigid frame 90, which is similar to the connection between the rigid frame 2 and the adult seat 14 in the first 1 and second 40 embodiments of the swing. Due to this arrangement, it is possible for an adult user to hold onto the frame and then sit on the swing in an easy manner without having to crawl into a frame or crawl in between flexible chains. The adult seat is arranged such that the rigid frame is located near the middle of the seat. In this way, the user can have one leg on each side of the rigid frame. In other words, one could say that a portion 88*a* of the seat extends to the left of the frame and a portion 88*b* extends to the right of the frame. It could also be said that the seat is symmetrical about a vertical plane which goes through the frame.

It should be noted that in the above description, the rigid frame in all embodiments is comprised of bent metal tubes. However, it should be clear to the person skilled in the art that the rigid frame could be assembled in other ways. For example, a frame made from composite materials could be provided. In another example, a frame having a wooden structure with flat panels could be provided. There are lots of different possibilities.

Figure 19:
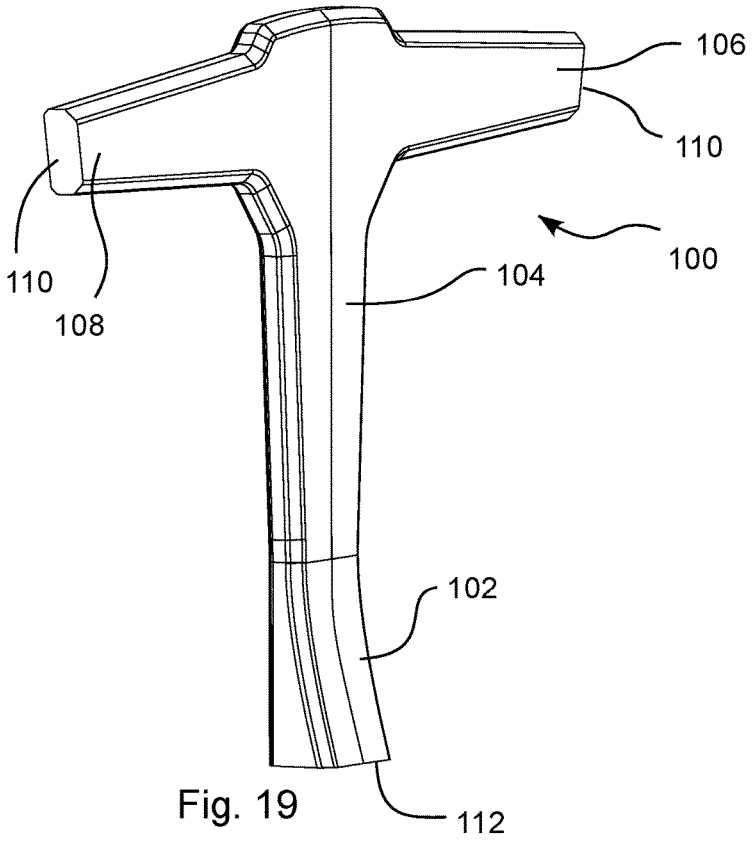
FIG. 19 shows a perspective schematic view of an embodiment of a child seat suitable for a toddler in a first configuration.
Figure 20:
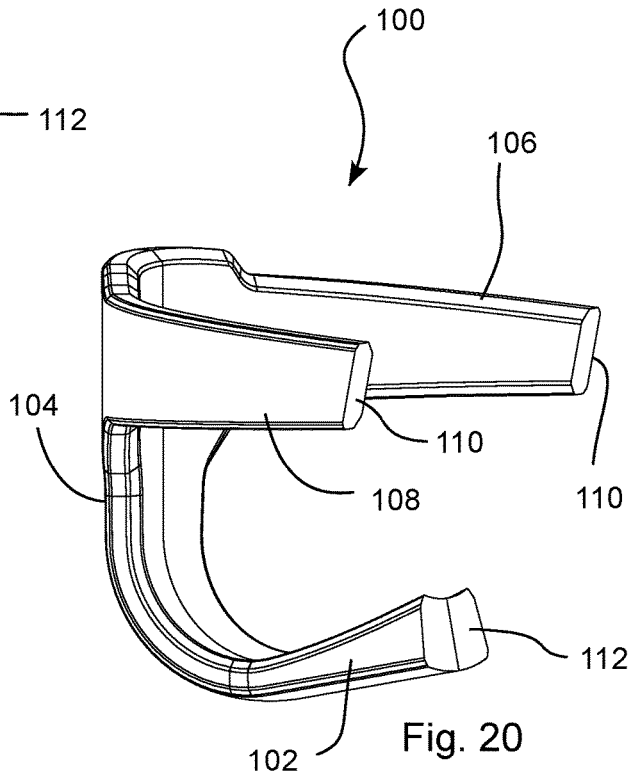
FIG. 20 shows the seat of FIG. 19 in a second configuration.

FIGS. 19 and 20 illustrate schematically a seat 100 for a swing which can be suitable for use with a swing of the current invention. However, it should be noted that the seat as shown in FIGS. 19 and 20 could also be used in other swings and/or other playground equipment.

The seat 100 is formed from a form moulded flexible plastic material which can be bent and formed into different shapes. The seat is shown in a flat configuration in FIG. 19 and in a bent configuration in FIG. 20. The seat comprises a seating portion 102, a back supporting portion 104, a left supporting portion 106 and a right supporting portion 108. In the first or flat configuration shown in FIG. 19, it can be seen that the different portions are essentially co-planar and form a flat element. As such the angles between the left supporting portion and the back supporting portion, between the right supporting portion and the back supporting portion and between the back supporting portion and the seating portion are all around 180 degrees. As can be seen by comparing FIGS. 19 and 20, it can be seen that the left and right side supporting portions and the seating portion are pivotably connected to the back supporting portion. As such, in the second configuration, the angle between the back supporting portion and the left and right supporting portions is approximately 90 degrees and the angle between the seating portion and the back supporting portion is approximately 80 degrees.

Inside the plastic material, could be arranged strengthening elements, for example wire portions, and/or fittings for connecting to other components. For example, in the swing shown in FIG. 1, the ends 110 of the side supporting portions and the end 112 of the seating portion are connected to the tubular steel portions of the swing via brackets (not shown) which are at least partly integrated into the material of the seat.

The strengthening elements and/or the connection fittings could be integrated into the seat portion via over moulding (or insert moulding). In other words, the wire portions and/or the fittings can be placed into the mould prior to starting the moulding operation. During the moulding operation, the strengthening elements and/or the connection fittings are covered by moulding material and in this way integrated directly into the construction of the seat. In order to provide a stronger connection between the in moulded elements and the material of the seat, recesses/protrusions can be formed on the elements which mechanically engage with the material of the seat. By forming the seat in a flat configuration, it is easier to integrate strengthening and other elements into the seat portion. The elements can be provided into the form in an easy manner and then over-moulded. In order to provide stiffness to the seating portion of the seat, the seating portion of the seat could be provided with recesses which engage with stiffening portions fastened directly to the tubular frame structure. For example, two tubes could be welded to the frame structure onto which the seating portion could be placed. In order to form the connection between the seat and the frame of the swing, a tube could be in moulded into the seat which can engage with a corresponding tube on the frame.

It is to be noted that the figures and the above description have shown the example embodiments in a simple and schematic manner. Many of the specific mechanical details have not been shown since the person skilled in the art should be familiar with these details and they would just unnecessarily complicate this description.

The invention claimed is:

1. A swing comprising an adult seat and a child seat, said two seats are connected together via a common frame and are arranged such that the two seats face each other, wherein a. the common frame comprises a rigid frame, said rigid frame having a first portion, an intermediate portion, a middle portion and a second portion, said middle portion being arranged between the first and second portions, said intermediate portion connecting the first portion and the middle portion, b. the first portion of the swing comprises two connecting elements spaced apart from each other along a horizontal axis which is perpendicular to the swinging direction, the distance between said two connecting elements being greater than 10 cm and the swing is arranged to be suspended from said two connecting elements of the first portion, c. the adult seat is attached to the second portion, d. the child seat is attached to the middle portion, e. the intermediate portion is arranged such that when an adult is seated in the adult seat and a child is seated in the child seat, the intermediate portion is located between the adult and the child;

f. the rigid frame comprises a bent tubular structure;

g. the bent tubular structure comprises two bent tubes joined together along a center plane of the swing, said two bent tubes forming left and right sides of the rigid frame and being formed as symmetrical copies of each other; and h. the rigid frame is arranged such that the first portion is arranged at a first end of the two bent tubes and the second portion is arranged at a second end of the two bent tubes.

2. A swing according to claim 1, wherein the adult seat is connected to the rigid frame such that a portion of the adult seat extends to the left of the second portion of the rigid frame, and a portion of the adult seat extends to the right of the second portion of the rigid frame.

3. A swing according to claim 1, wherein the swing is arranged such that a seating surface of the adult seat is arranged lower than a seating surface of the child seat.

4. A swing according to claim 1, wherein the child seat is suitable for holding a toddler in a secure manner, and said child seat comprises a back support portion and/or side support portions.

5. A swing according to claim 4, wherein the child seat comprises a seating surface, a back supporting portion, two side supporting portions, and a front supporting portion.

6. A swing according to claim 1, wherein the intermediate portion of the rigid frame comprises two spaced apart bars which are suitable for holding onto by an adult sitting on the adult seat.

7. A swing according to claim 6, wherein the two spaced apart bars extend upwardly to two upper free ends, said two upper free ends being provided with the connecting elements to connect the swing to flexible support elements.

8. A swing according to claim 1, wherein the rigid frame has a Y shape when seen along the swinging direction, where the second portion of the rigid frame is narrower than the first portion of the rigid frame.

9. A swing according to claim 8, wherein the distance between the two tubes of the first portion is greater than 20 cm, and wherein the portion of the rigid frame located between the child seat and the second portion has a maximum width of less than 20 cm.

10. A swing according to claim 1, wherein the adult and/or the child seat are rigidly connected to the rigid frame.

11. A swing assembly comprising: a swing according to claim 1, a support structure, and pivotable elongated elements, said swing being supported by said pivotable elongated elements connected between said support structure and the first portion of the swing.

* * * * *